US006519878B2

(12) United States Patent
Yoshiaki

(10) Patent No.: US 6,519,878 B2
(45) Date of Patent: Feb. 18, 2003

(54) SHOE SOLES

(75) Inventor: Miyata Yoshiaki, Osaka (JP)

(73) Assignee: Miyata Co., Ltd., Osaka (JP)

( * ) Notice: Subject to any disclaimer, the term of this patent is extended or adjusted under 35 U.S.C. 154(b) by 0 days.

(21) Appl. No.: 09/834,925

(22) Filed: Apr. 16, 2001

(65) Prior Publication Data

US 2002/0050079 A1 May 2, 2002

(30) Foreign Application Priority Data

Oct. 27, 2000 (JP) ..... 2000-329545

(51) Int. Cl.[7] ..... A43B 5/00; A43B 23/00; A63B 23/08; A63B 21/06

(52) U.S. Cl. ..... 36/132; 36/136; 482/79; 482/93

(58) Field of Search ..... 36/132, 136; 482/79, 482/83, 105, 93

(56) References Cited

U.S. PATENT DOCUMENTS 3,109,245 A * 11/1963 Glynn ..... 36/132
3,517,928 A * 6/1970 Shanahan ..... 36/132
4,686,781 A * 8/1987 Bury ..... 36/132
4,709,921 A * 12/1987 Valuikas et al. ..... 36/132
5,758,435 A * 6/1998 Miyata ..... 36/132

FOREIGN PATENT DOCUMENTS

GB 2100969 * 1/1983 ..... 36/132

* cited by examiner

*Primary Examiner*—Anthony D. Stashick
(74) *Attorney, Agent, or Firm*—Wenderoth, Lind & Ponack, L.L.P.

(57) ABSTRACT

A shoe sole having a resilient outsole including a weight for applying a larger-than-normal load on the leg muscles. The outsole has a single recess formed on the upper surface thereof and extending in a lengthwise direction from a toe portion to a heel portion of the outsole. The recess has an outline that is similar to the outline of the outsole and a single weight is embedded in the recess. The single weight comprises a mixture of a resilient material and metallic grains and has an outline that is similar to the outline of the outsole. The weight is formed so as to be relatively thin at the toe portion and relatively thick at the heel portion.

6 Claims, 3 Drawing Sheets

SHOE SOLES

BACKGROUND OF THE INVENTION

The present invention relates to shoe soles of training shoes, walking shoes, business shoes, casual shoes and the like which can apply a larger-than-normal load to leg muscles and strengthen the lower half of the body of the wearer of the shoes while the wearer of the shoes is walking or otherwise exercising.

Conventional training shoes for strengthening the lower half of the body during walking are provided with a weight and the like embedded in soles to increase the overall weight of shoes. For example, U.S. Pat. No. 5,231,776 discloses a shoe having a weight-retaining matrix of lattice grid structure molded to a sole, each matrix being filled with metallic balls. Instead of such metallic balls, a shoe disclosed in U.S. Pat. No. 5,758,435 is provided with a shoe sole having weight chambers which are filled with the weights comprising a mixture of metallic grains and adhesives.

However, in the above conventional shoes, the operations of filling metallic balls or weights into a large number of matrixes or chambers are extremely troublesome. Furthermore, when the weight of the metallic balls or weights varies in each matrix or chamber, the overall balance of shoe soles is destroyed and walking comfort deteriorates.

In Japanese Utility Model Publication No. 45-21005, there is disclosed a shoe having a shoe sole comprising an outsole, a midsole and an insole wherein a plurality of recesses are formed on the upper surface of the midsole in the width direction of the sole and parallel to one another in the lengthwise direction of the sole and weights are embedded in the recesses. The weights comprise a mixture of resilient materials such as natural rubber, synthetic rubber or synthetic resin etc. and metallic grains. In manufacturing such a shoe, the weights should be made in conformity with the concave form of the recesses and each weight should be embedded in a corresponding recess of the same form. Thus it is extremely troublesome to embed the weights and the workability is poor.

Furthermore, in Japanese Utility Model Application laid-open under No. 56-103205, there is disclosed a shoe having a shoe sole provided with a recess at the toe portion and at the heel portion respectively and provided with a metallic weight embedded in the respective recess. In this construction, embedding the weights is comparatively easy. However, when the weight difference is large between the two weights, the weight balance of the shoe is destroyed and eventually an excessive load is applied to legs of the wearer of such shoe, and as a result, the shoe may cause bodily injury instead of strengthening the lower half of the body of the wearer. In addition, since the weight is made of metal and is not flexible, walking comfort deteriorates.

As mentioned above, conventional shoes in any structures have merits and demerits. It is therefore an object of the present invention to provide a shoe sole having good overall weight balance and flexibility suitable for walking, while improving the operational efficiency of embedding weights.

SUMMARY OF THE INVENTION

According to the present invention, there is provided a shoe sole including a resilient outsole having a single recess bored on the upper surface and extending in the lengthwise direction from a toe portion to a heel portion of the outsole.

The recess has a similar outline to the outline of the outsole, and a single weight comprising a mixture of a resilient material and metallic grains is embedded in the recess.

In such a shoe sole, the single weight can be easily embedded in the single recess bored on the upper surface of the outsole after being prepared in a separate manufacturing process, and the workability of embedding the weight is improved. Since the weight is formed with a mixture of a resilient material and metallic grains, it has resilience to function as a shock absorber, so that there is no need to adopt such shock absorbing materials such as rubber sponges and the like. The metallic grains are made of iron, stainless steel or the like having a large specific gravity and may be granular, powder or flake in shape.

It is preferred that the single weight has a similar outline to the outline of the outsole and fits in the recess having a similar outline to the outline of the outsole, so that the weight can be easily disposed at a well-balanced position in the outsole and that the load of weight applied to the sole disperses widely. It is then possible to maintain a proper weight balance of the shoe sole. The resilient weight deforms when a load is applied thereto, but as the recess is formed to fit over the entire sole of a foot, the deformation of the weight occurs uniformly, so that weight balance is maintained when the a load is applied the shoe sole.

It is also preferable that the weight is formed so as to be thin at the toe portion and thick at the heel portion, so that the weight can be easily bent from the toe portion. Thus, the flexibility of the outsole is maintained inspite of the existence of the weight. As the heel portion is formed so as to be thick, it receives firmly the heel of the foot without causing excessive deformation.

Also, it is preferred that the weight comprises a resilient housing and a mixture of a resilient material and metallic grains filled in the housing.

There is also provided a shoe sole comprising a resilient outsole having a single recess bored on the upper surface and extending in the lengthwise direction from a toe portion to a heel portion of the outsole and a single weight comprising a resilient housing and a mixture of a resilient material and metallic grains filled in the housing. The recess has a similar outline to the outline of the outsole, and the single weight has a similar outline to the outline of the outsole and fits in the recess. The weight is formed so as to be thin at the toe portion and thick at the heel portion with an upper surface that is level with an upper surface of the outsole.

In case the upper surface of the weight is level with the upper surface of the outsole, shoe components to be superposed on the outsole are stably set without causing gaps therebetween, so that the durability of the shoe is increased and no strange feelings are experienced by the wearer.

Other features and objects of the present invention will become apparent from the following description made with reference to the accompanying drawings, in which:

DETAILED DESCRIPTION OF THE PREFERRED EMBODIMENT

Figure 1:
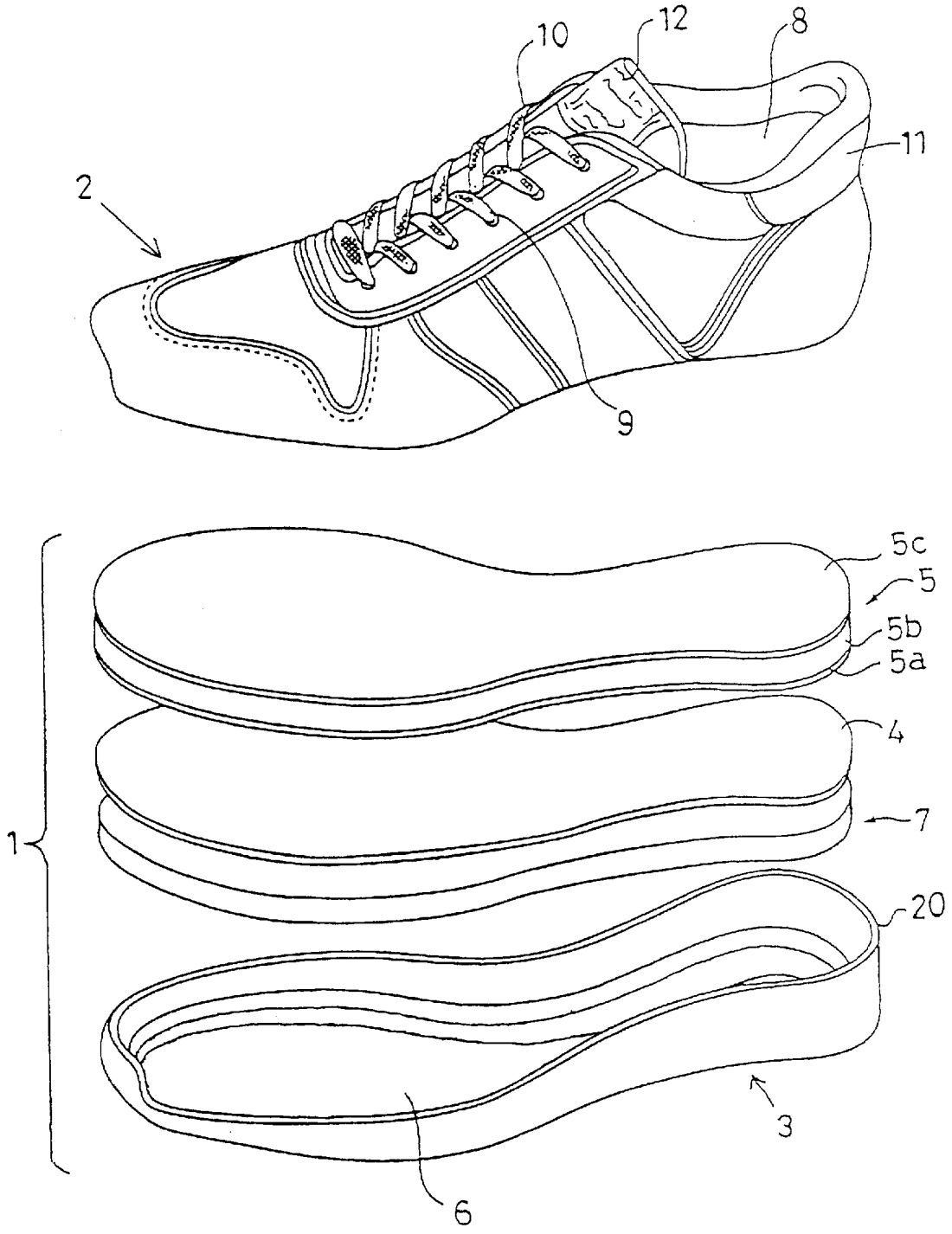
FIG. 1 is an exploded perspective view of a training shoe embodying the shoe sole in accordance with the present invention.
Figure 2:
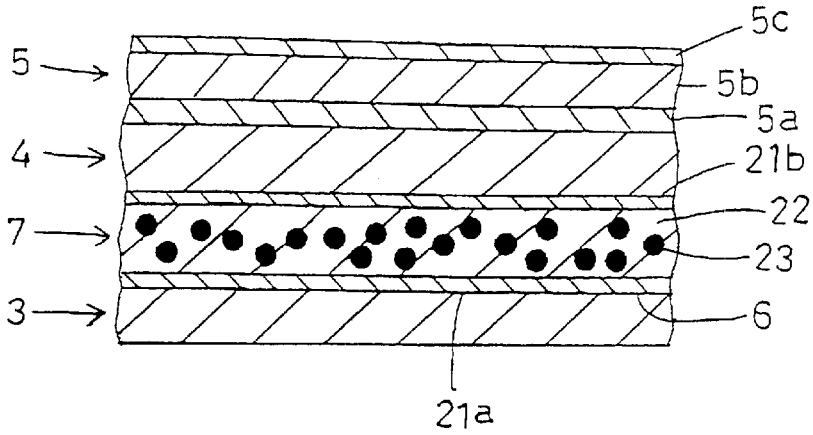
FIG. 2 is a sectional view of the shoe sole.
Figure 3:
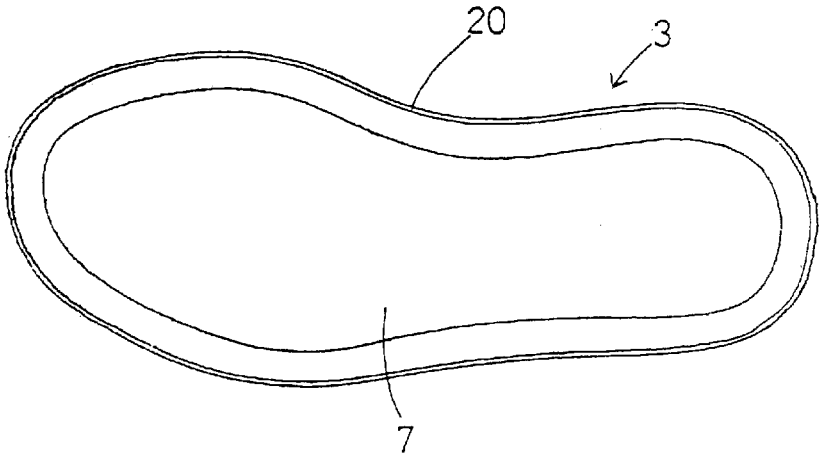
FIG. 3 is a plan view of the outsole.

FIG. 1 shows a training shoe having an embodiment of a shoe sole constructed in accordance with the present invention. The training shoe comprises a shoe sole 1 to be brought into contact with the sole of a foot and an upper 2 provided integrally with the shoe sole 1. The shoe sole 1 comprises an outsole 3, a midsole 4 and an uppermost insole 5 superposed one on another in this order from below. A single recess 6 is bored on the upper surface extending in a lengthwise direction from a toe portion to a heel portion of the outsole 3, and a resilient weight 7 is embedded in the recess 6.

The upper 2 is made of synthetic fiber, synthetic leather or genuine leather and has a mouth 8 through which a foot is inserted and eyelets 9 through which a shoe lace 10 is passed. The degree of the opening of the mouth 8 is adjustable by tightening the shoe lace 10. On the heel side of the mouth 8, an ankle pad 11 made of urethane foam is provided so as to protect the Achilles tendon of a shoe wearer. Instead of the shoe lace 10, a fastening means having resilient hook and loop fasteners may be available for adjustably fixing the foot to a shoe.

The upper 2 is provided with an integral tongue 12 having an urethane foam pad that is thicker than a conventional pad. The thick tongue 12 will minimize shock and compression exerted on the instep of a foot. It is thus possible to lighten a load extended on an ankle.

The outsole 3 is made of a resilient thermoplastic rubber such as EVA(ethylene-vinyl acetate copolymer), thermoplastic urethane rubber and the like.

The bottom of the outsole 3 is formed in such a manner that the tip of the toe portion rises and the portion extending from the toe portion to the heel portion is flat and the rear end of the heel portion is cut on a slant. The form of the bottom of the outsole 3 is not limited to the configuration described above. For example, a shank may be formed between the toe portion and the heel portion for walking shoes, business shoes and casual shoes.

The midsole 4 is made of a regular thin rubber, leather and the like. The insole 5 has a three-ply structure having a total thickness of 5 mm and comprising, for example, an EVA (ethylene-vinyl acetate copolymer) sponge layer 5*a*, a foamed latex layer 5*b* and a polyester substrate 5*c* laminated in this order from below and bonded together with an adhesive. An insole used in an ordinary training shoe with no added weights is less than 3 mm thick. Using the midsole 4 and the insole 5, which has a thickness larger than ordinary, provides enhanced shock absorbability and walking comfort for the wearer.

Figure 4:
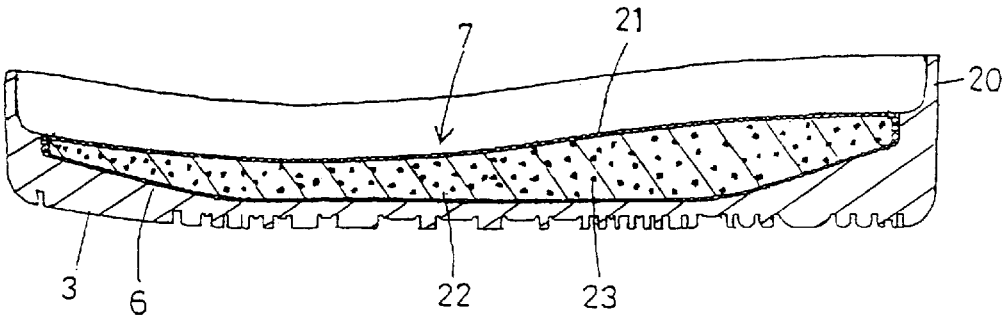
FIG. 4 is a sectional view in the lengthwise direction of the outsole.
Figure 5:
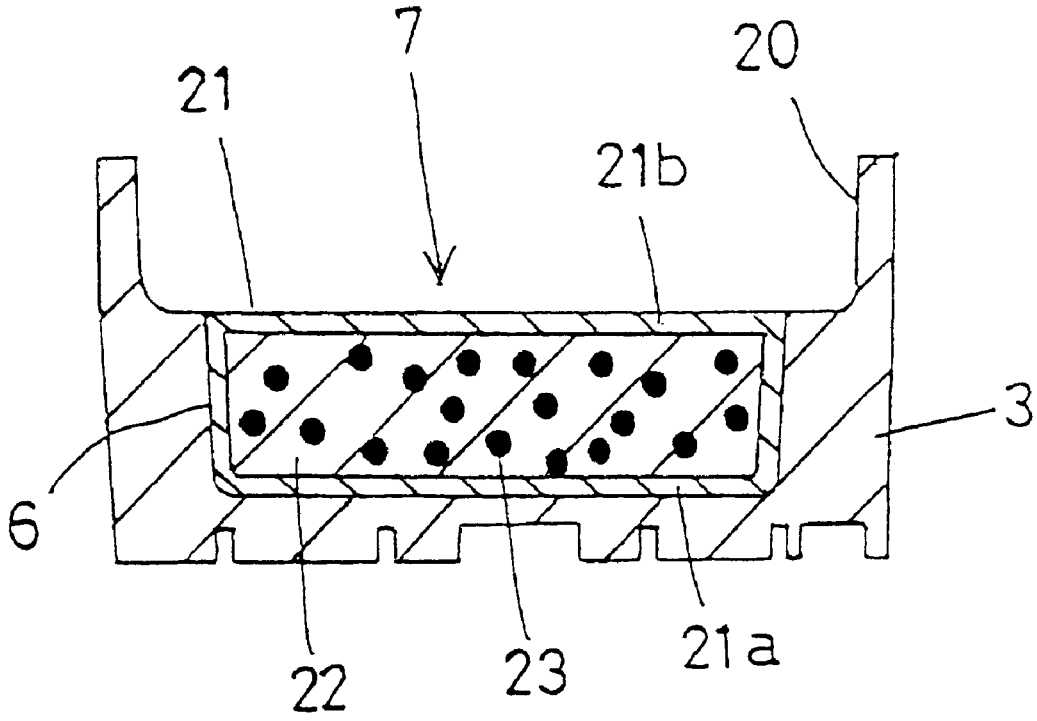
FIG. 5 is a sectional view in the width direction of the outsole.

As shown in FIG. 4 and FIG. 5, the upper surface of the outsole 3 is concave so as to form a recess 6 and a rising peripheral wall 20 is provided along the edge thereof. The recess 6 formed on the upper surface of the outsole 3 has an outline that is similar to the outline of the outsole 3. The bottom of the recess 6 has a profile that slopes downward from the tip of the toe portion to the center portion in the lengthwise direction and becomes flat toward the heel portion and slopes upward toward the rear end of the heel portion. Thus, the depth of the recess 6 is shallow at the toe portion and deep at the heel portion. The recess 6 may be integrally formed when molding the outsole 3 with a molding machine, or formed with a die after the outsole 3 has been molded.

The weight 7 has an outline that is similar to the outline of the outsole 3 and fits in the recess 6 that is bored on the upper surface of the outsole 3 and the weight is formed so as to be thin at the toe portion and thick at the heel portion. The upper surface of the weight 7 is level with the upper surface of the outsole 3 when embedded in the recess 6. It is thus easy to laminate other shoe components on the outsole 3.

The weight 7 is a molded element which comprises a hollow housing 21 and a mixture of a resilient material 22 and metallic grains 23 filled in the housing 21. The housing 21 is formed so as to conform to the concave shape or configuration of the recess 6, and the housing comprises a container 21 a having an open top and a closure 21*b*. The housing 21 is filled with metallic grains 23 together with the resilient material 22, so that they are not exposed externally and are fixed stably in the housing 21. Thus, the metallic grains 23 do not shift during walking or exercising and the walking comfort is not adversely affected.

The resilient material 21 is natural rubber, synthetic rubber, elastomer, or any optional mixture thereof, for example, the mixture of styrene-butadiene rubber, nitrile rubber, isoprene rubber and barium sulfate as a filler. The filler has a large specific gravity and occupies 50% of the mass of the weight 7. The housing 21 may be formed of the same resilient material as the resilient material 22 or formed of a different resilient material. The metallic grains 23 may be made of iron, stainless steel and the like. Iron grains are preferred from an economical point of view, and nickel plating is preferred for preventing rust. Instead of metallic grains 23, metallic powders or metallic flakes may also be used.

The weight 7 may be produced as follows. First the container 21 a having an open top is formed so as to conform to the concave shape or configuration of the recess 6. Then the mixture of the resilient material 22, in a fluid state, and the metallic grains 23 is poured into the container 21 a to a level such that the mixture is near the open top. It is preferred that the metallic grains 23 are dispersed uniformly. After the container 21 a is capped with the closure 21*b*, the housing 21 is formed by applying heat and pressure to bond integrally the container 21 a and the closure 21*b*. The mixture in the housing 21 sets therein and is integrated with the container 21 a and the closure 21*b*. Thus, the weight 7 is produced with the same shape as the concave shape or configuration of the recess 6. The weight 7 is embedded in the recess 6 of the outsole 3. Adhesives may be used to fix the weight in the recess 6. The upper 2 is cemented on the flat upper surface of the outsole 3 including the weight 7 which is embedded therein.

Furthermore, the upper 2 is stitched to the outsole 3. Thus, the upper 2 is securely fixed to the outsole 3 so as to sustain the weight of the outsole 3 and the durability thereof is enhanced. The midsole 4 is laminated and bonded on the outsole 3 and subsequently the insole 5 is superposed on the midsole 4 to complete a shoe. The insole 5 is arranged so as to be detachable.

When a person walks in the shoes constructed in accordance with the above, a load which is larger three or four times than when walking in ordinary training shoes will act on the wearer's leg, and they are trained and strengthened. Moreover, burning off excess fat is accelerated and shape-up can be accomplished. Although the shoe sole 1 is made heavier than ordinary training shoes, shocks applied to feet and legs can be absorbed by the resilient weight 7 and insole 5. Namely, due to the high cushioning property, shocks are scarcely transmitted to feet and legs, and thus it is possible to prevent injuries to feet and legs. During walking, the stepping portion, that is, the region between the toe portion and the shank of the shoe sole 1, is subjected to a bending force. However, the weight 7 is pliable at the thin toe portion and the pliability of the shoe sole is not reduced and thus the wearer can walk and run smoothly and comfortably.

When the weight 7 is produced in a separate process, the weight of the mixture is adjusted so as to be uniform with respect to all shoes of the same size. Thus, the weight of the weight 7 can be easily made uniform and the weight difference can be minimized, which contributes the quality improvement of the shoe sole. It is also possible to change the weight of the sole 1 without difficulty.

The weight 7 is formed in conformity to the outline of the outsole 3 and the outlines of the outsoles 3 are similar to each other in spite of the difference in size. Accordingly the weight 7 of a common single size may be applicable to every size of outsole, which contributes to the mass-productivity of the shoe sole 1. Also, the recess 6 can be formed to conform to the weight 7 of a common single size, so that mis-assembling of the weight 7 in the recess 6 never occurs. Thus, the workability is extremely enhanced and the manufacture's cost is also remarkably reduced.

The present invention is not limited to the above-described specific embodiments but is subject to various changes and modifications. For example, the weight may be formed of a double structure such that the stepping portion, that is, the region between the toe portion and the shank or a flat center portion, is made of a resilient material with low rigidity and the remaining portion is made of a resilient material with high rigidity. With this arrangement, the stepping portion thereof becomes more flexible, while the flexibility at the heel portion is restrained. On the upper surface of the weight, a plurality of grooves may be formed at the stepping portion thereof in the width direction, so that the weight becomes flexible at the stepping portion. Such grooves may be formed also in the lengthwise direction of the weight, so that the toe portion of the weight can be easily twisted. Instead of such grooves, the weight may be perforated so as to be deformable.

According to the present invention as described above, the weight can be easily embedded in the recess of the outsole. Furthermore, the shape of the weight is formed to conform to the shape of the recess, and thus the weight can be embedded in the recess without errors. The construction of the weight contributes the mass-productivity of the shoe sole and the manufacturing costs can be reduced.

In addition, by making the stepping portion of the weight thin, the flexibility of the weight is enhanced, so that the shoe sole having walking comfort can be provided.

What is claimed is:

1. A shoe sole comprising:

a resilient outsole having in a lengthwise direction from a toe portion to a heel portion of said resilient outsole, said recess having an outline that is similar to an outline of said resilient outsole; and a single integral weight inserted in said recess of said resilient outsole, said weight comprising a mixture of metallic grains and a resilient material, wherein said weight comprises a resilient housing filled with said mixture of metallic grains and resilient material, wherein said resilient housing comprises a container having an open top, and a closure bonded to the container, and wherein a bottom surface of said container is adhesively bonded in said recess of said outsole to secure the weight therein.

2. A shoe sole as claimed in claim 1, wherein said single weight fits in said recess and has an outline that is similar to the outline of said resilient outsole, and said weight is formed so as to be relatively thin at the toe portion and relative thick at the heel portion.

3. A shoe sole comprising:

a resilient outsole having a single recess formed on an upper surface thereof, said recess extending in a lengthwise direction from a toe portion of said outsole to a heel portion of said outsole, wherein said recess has an outline that is similar to an outline of said resilient outsole; and a single integral weight comprising a resilient housing filled with a mixture of metallic grains and a resilient material, said weight having an outline that is similar to the outline of said resilient outsole, and said weight fits in said recess, said weight being formed so as to be relatively thin at the toe portion and relatively thick at the heel portion, and an upper surface of said weight is level with an upper surface of said resilient outsole, wherein said housing comprises a container having an open top, and a closure bonded to the container, and wherein a bottom surface of said container is adhesively bonded in said recess of said outsole to secure the weight therein, and said housing is shaped so as to conform to the shape of said recess.

4. A shoe sole as claimed in claim 3, further comprising a midsole bonded to the outsole, and an insole superposed on said midsole.

5. A shoe sole as claimed in claim 4, wherein said insole is a three-ply structure.

6. A shoe sole comprising:

a resilient outsole having a single recess formed on an upper surface thereof, said recess extending in a lengthwise direction from a toe portion to a heel portion of said resilient outsole, said recess having an outline that is similar to an outline of said resilient outsole; and a single integral weight inserted in said recess of said resilient outsole, said weight extending continuously over a bottom surface of said recess, and said weight comprising a mixture of a metallic material and a resilient material, wherein said single weight fits in said recess and has an outline that is similar to the outline of said resilient outsole, and said weight is formed so as to be relatively thin at the toe portion and relatively thick at the heel portion, wherein said weight comprises a resilient housing filled with said mixture of metallic material and resilient material, wherein said resilient housing comprises a container having an open top, and a closure bonded to the container, and wherein a bottom surface of said container is adhesively bonded in said recess of said outsole in order to secure the weight therein.

* * * * *